United States Patent [19]

Katoh

[11] Patent Number: 5,075,198

[45] **Date of Patent: * Dec. 24, 1991**

[54] SILVER HALIDE PHOTOGRAPHIC MATERIAL

[75] Inventor: Kazunobu Katoh, Kanagawa, Japan

[73] Assignee: Fuji Photo Film Co., Ltd., Kanagawa, Japan

[ * ] Notice: The portion of the term of this patent subsequent to Apr. 3, 2007 has been disclaimed.

[21] Appl. No.: 608,593

[22] Filed: Oct. 31, 1990

Related U.S. Application Data

[63] Continuation of Ser. No. 266,604, Nov. 2, 1988, abandoned.

[30] Foreign Application Priority Data

Nov. 2, 1987 [JP] Japan ..... 62-277579

[51] Int. Cl.[5] ..... G03C 1/06

[52] U.S. Cl. ..... 430/264; 430/512; 430/583

[58] Field of Search ..... 430/264, 583, 512

[56] References Cited

U.S. PATENT DOCUMENTS

| | | | |
|---|---|---|---|
| 4,221,857 | 9/1980 | Okutou et al. | 430/264 |
| 4,243,739 | 1/1981 | Mifume et al. | 430/567 |
| 4,681,836 | 7/1987 | Inoue et al. | 430/264 |
| 4,722,884 | 2/1988 | Inoue et al. | 430/264 |
| 4,737,442 | 4/1988 | Yagihara et al. | 430/264 |
| 4,800,150 | 1/1989 | Katoh | 430/264 |
| 4,914,002 | 4/1990 | Inoue et al. | 430/264 |
| 4,942,121 | 7/1990 | Kajiwara et al. | 430/583 |
| 4,956,257 | 9/1990 | Inoue | 430/264 |
| 4,987,052 | 1/1991 | Hirano et al. | 430/264 |

OTHER PUBLICATIONS

Research Disclosure, vol. 176, No. 17643 (Dec. 1978), Article IV, p. 23.

Patent Abstracts of Japan, vol. 10, No. 183 (P-472) [2239], 26th Jun. 1986; & JP-A-6129837 (Fuji Photo Film Col, Ltd.), 10-02-1986.

Research Disclosure, No. 235, Nov. 1983, pp. 346-352, Abstract No. 23510, Havant, Hampshire, GB: "Development Nucleation by Hydrazine and Hydrazine Derivatives".

*Primary Examiner*—Charles L. Bowers, Jr.

*Assistant Examiner*—Thomas R. Neville

*Attorney, Agent, or Firm*—Sughrue, Mion, Zinn, Macpeak & Seas

[57] ABSTRACT

A negative type silver halide photographic material comprising a support having thereon at least one silver halide emulsion layer, wherein the silver halide emulsion layer or another hydrophilic colloid layer provided on the support contains (1) a compound represented by formula (I) having substantially no absorption maximum in the visible region of the spectrum and (2) a hydrazine compound represented by formula (II):

(I)

wherein $Z^{11}$ and $Z^{12}$ each represents a non-metallic atomic group completing a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus, or a quinoline nucleus; $R^{11}$ and $R^{12}$ each represents an unsubstituted or substituted alkyl group, at least one of said $R^{11}$ and $R^{12}$ having an acid group; Xo represents a charge balancing ion; and n represents 0 or 1;

(II)

wherein $A_1$ and $A_2$ each represents a hydrogen atom, or one of said $A_1$ and $A_2$ represents a hydrogen atom and the other represents a sulfinic acic group or an acyl group; $R_1$ represents an aliphatic group, an aromatic group, or a heterocyclic group; $R_2$ represents a hydrogen atom, an alkyl group, an aryl group, an alkoxy group, an aryloxy group, or an amino group; at least one of $R_1$ and $R_2$ has an adsorption acceleration group with respect to silver halide; and $G_1$ represents a carbonyl group, a sulfonyl group, a sulfoxy group, a phosphoryl group, or an iminoethylene group.

10 Claims, No Drawings

SILVER HALIDE PHOTOGRAPHIC MATERIAL

This is a continuation of application No. 07/266,604 filed Nov. 2, 1988, now abandoned.

FIELD OF THE INVENTION

This invention relates to a silver halide photographic material giving photographic characteristics of very high contrast and high sensitivity suitable for use in the field of photomechanical processes.

BACKGROUND OF THE INVENTION

It is that photographic images having very high contrast can be formed by using a certain kind of a silver halide photographic material and such a photographic image-forming material and development processes therefor have been used in the field of photomechanical process.

For example, it is known to obtain line images or dot images having a high contrast and a high blackened density, wherein the image portions and non-image portions are clearly distinguished from each other, by processing a lith-type silver halide photographic material containing silver chlorobromide (having a silver chloride content of at least 50%) with a hydroquinone developer having a very low effective concentration (usually less than about 0.1 mole/liter) of sulfite ions However, the aforesaid developer is very unstable and subject to air oxidation due to the low sulfite concentration in the developer, and hence for keeping the activity of the developer, various efforts and proposals have been made at present.

Accordingly, an image-forming system capable of improving the stability in the aforesaid development process (i.e., in a lith development process) and obtaining the photographic characteristics of a super-high contract by developing a silver halide photographic material using a developer having a high storage stability has been desired and systems of forming negative images having a super-high contrast of over 10 in gamma ($\gamma$) by developing surface latent image-type silver halide photographic materials containing specific acylhydrazine compounds using a developer having pH of from 11.0 to 12.3, containing at least 0.15 mole/liter of a sulfite preservative, and good storage stability are proposed as described in U.S. Pat. Nos. 4,166,742, 4,168,977, 4,221,857, 4,224,401, 4,243,739, 4,272,606, 4,311,781, 4,269,929, and 4,650,746. The new image-forming systems have the feature that silver iodo-bromide and silver chloroiodobromide can be also used, while in a conventional super-high contrast image-forming system, only silver chlorobromide having a high silver chloride content can be used.

As the hydrazine compound which is used for such a super-high contrast image-forming system, various kinds of compounds have been described, such as in the aforesaid U.S. patents. However, many of these hydrazine compounds give a high sensitivity, a high contrast, and the high maximum density (Dmax), but have a disadvantage in that they cause an undersirable phenomenon called "black pepper" or "Black pepper spot" by infectious development. Also, it is known that hydrazine compounds having a group adsorbing to silver halide grains are highly active contrast-increasing agents capable of increasing contrast by a small addition amount thereof, but they have a disadvantage of causing extensive black pepper spots.

SUMMARY OF THE INVENTION

An object of this invention is, therefore, to provide a silver halide photographic material capable of giving a high blackened density with less formation of black pepper spots at a high sensitivity and a high contrast (e.g.,.higher than 10 in $\gamma$) and also to provide an image-forming process using the silver halide photographic material.

Another object of this invention is to provide a silver halide photographic material giving less residual color.

It has now been discovered that the aforesaid objects can be attained by the present invention, as set forth hereinbelow.

That is, the invention provides a negative type silver halide photographic material comprising support having thereon having at least one silver halide emulsion layer, wherein the silver halide emulsion layer or another hydrophilic colloid layer provided on the support contains (1) a compound represented by formula (I) having substantially no absorption maximum at the visible wavelength region, and (2) a hydrazine compound represented by formula (II):

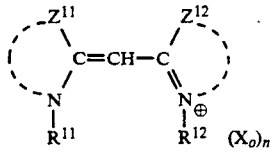

(I)

wherein $Z^{11}$ and $Z^{12}$ each represents a non-metallic atomic group completing a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus, or a quinoline nucleus; $R^{11}$ and $R^{12}$ each represents an unsubstituted or substituted alkyl group, at least one of said $R^{11}$ and $R^{12}$ having an acid group; X represents a charge balancing ion; and n represents 0 or 1;

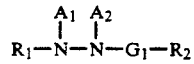

(II)

wherein $A_1$ and $A_2$ each represents a hydrogen atom or one of said $A_1$ and $A_2$ represents a hydrogen atom and the other represents a sulfinic acid residue or an acyl group; $R_1$ represents an aliphatic group, an aromatic group, or a heterocyclic group; $R_2$, represents a hydrogen atom, an alkyl group, an aryl group, an alkoxy group, an aryloxy group, or an amino group; at least one of said $R_1$ and $R_2$ has an adsorption accelerating group with respect to silver halide; .and $G_1$ represents a carbonyl group, a sulfonyl group, a sulfoxy group, a phosphoryl group, or an iminomethylene group.

DETAILED DESCRIPTION OF THE INVENTION

The compounds represented by formula (I) having substantially no absorption maximum at the visible region are explained in further detail below.

Examples of the heterocyclic rings formed by $Z^{11}$ and $Z^{12}$ include a benzoxazole nucleus, a benzothiazole nucleus, a naphthoxazole nucleus, a naphthothiazole nucleus, a thiazole nucleus, or an oxazole nucleus, more preferably a benzoxazole nucleus, a benzothiazole nucleus or a naphthoxazole nucleus, and, more preferably, a benzoxazole nucleus or a naphthoxazole nucleus.

The heterocyclic rings formed by $Z^{11}$ or $Z^{12}$ may be substituted with one to four substituents such as a halogen atom (e.g., fluorine, chlorine, bromine, and iodine), a nitro group, an alkyl group (having, preferably, from 1 to 4 carbon atoms, such as methyl, ethyl, trifluoromethyl, benzyl, and phenetyl), an aryl group (e.g., phenyl), an alkoxy group (having, preferably, from 1 to 4 carbon atoms, such as methoxy, ethoxy, propoxy, and butoxy), a carboxy group, an alkoxycarbonyl group (having, preferably, from 2 to 5 carbon atoms, such as ethoxycarbonyl), a hydroxy group, a cyano group, etc.

In regard to $Z^{11}$ and $Z^{12}$ of formula (I), examples of the benzothiazole nucleus include benzothiazole, 5-chlorobenzothiazole, 5-nitrobenzothiazole, 5-methylbenzothiazole, 6-bromobenzothiazole, 5-iodobenzothiazole, 5-phenylbenzothiazole, 5-methoxybenzothiazole, 6-methoxybenzothiazole, 5-carboxybenzothiazole, 5-chloro-6-methylbenzothiazole, and 5-trifluoromethylbenzothiazole. Examples of the naphthothiazole nucleus are naphtho[2,1-d]thazole, naphtho[1,2-d]thiazole, naphtho-[2,3-d]thiazole, 5-methoxynaphtho[1,2-d]thiazole, and 5-methoxynaphtho[2,3-d]thiazole. Examples of the benzoselenazole nucleus are benzoselenazole, 5-chlorobenzoselenazole, 5-methoxybenzoselenazole, 5-hydroxybenzoselenazole, and 5-chloro-6-methylbenzoselenazole. Examples of the naphthoselenazole nucleus are naphtho[1,2-d]selenazole and naphtho[2,1-d]selenazole. Examples of the thiazole nucleus are thiazole, 4-methylthiazole, 4-phenylthiazole, and 4,5-dimethylthiazole. Examples of the thiazoline nucleus are thiazoline and 4-methylthiazoline.

In regard to $Z^{11}$ and $Z^{12}$ of formula (I), examples of the benzoxazole nucleus include benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-ethoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, and 5,6-dimethylbenzoxazole. Examples of the naphthoxazole include naphtho[2,1-d]oxazole, naphtho[1,2-d]oxazole, naphtho[2,3-d]oxazole, and 5-methoxynaphtho[1,2-d]oxazole.

Furthermore, in regard to $Z^{11}$ and $Z^{12}$ in formula (I), examples of the oxazole nucleus include oxazole, 4-methyloxazole, 4-phenyloxazole, 4-methoxyoxazole, 4,5-dimethyloxazole, 5-phenyloxazole, and 4-methoxyoxazole, Examples of the pyridine nucleus are 2-pyridine, 4-pyridine, 5-methyl-2-pyridine, and 3-methyl-4-pyridine. Examples of the quinoline nucleus are 2-quinoline, 4-quinoline, 3-methyl-2-quinoline, 5-ethyl-2-quinoline, 8-fluoro-2 quinoline, 6 methoxy-2-quinoline, 8-chloro-4-quinoline, and 8-methyl-4-quinoline. Examples of the benzimidiazole nucleus are 5,6-dichloro-1-ethylbenzimidazole and 6-chloro-1-ethyl-5-trifluoromethylbenzimdiazole.

In formula (I), the alkyl group shown by $R^{11}$ or $R^{12}$ includes a substituted or unsubstituted alkyl group and at least one of said $R^{11}$ and $R^{12}$ has an acid group such as a sulfo group, a carboxy group, etc.

The unsubstituted alkyl group is preferably an alkyl group having from 1 to 18 carbon atoms, and more preferably from 1 to 8 carbon atoms, such as methyl, ethylm n-propyl, n-butyl, n-hexyl, and n-octadecyl. Also, the substituted alkyl group has, preferably, the alkyl moiety having from 1 to 6 carbon atoms, and particularly preferably from 1 to 4 carbon atoms. The substituent on the alkyl moiety may also contain an alkyl group preferably having up to 8 carbon atoms or an aryl group preferably having from 6 to 14 carbon atoms. Examples of the substituted alkyl group are an alkyl group substituted by a sulfo group (the sulfo group may be bonded- thereto via an alkoxy group or an aryl group, e.g., 2-sulfoethyl, 3-sulfopropyl, 3-sulfobutyl, 4-sulfobutyl, 2-(3-sulfopropoxy)ethyl, 2-[2-(3-sulfopropoxy)ethoxy]ethyl, 2-hydroxy-3-sulfopropyl, p-sulfophenetyl, p-sulfophenylpropyl, etc.), an alkyl group substituted by a carboxy group (the carboxy group may be bonded thereto via an alkoxy group or an aryl group, e.g., carboxymethyl, 2-carboxyethyl, 3-carboxypropyl, 4-carboxybutyl, etc.), a hydroxyalkyl group (e.g., 2-hydroxyethyl, 3-hydroxypropyl, etc.), an acyloxyalkyl group (e.g., 2-acetoxyethyl and 3-acetoxypropyl), an alkoxyalkyl group (e.g., 2-methoxyethyl and 3-methoxypropyl), an alkyoxycarbonylalkyl group (e.g., 2-methoxycarbonylethyl, 3-methoxycarbonylpropyl, and 4-ethoxycarbonylbutyl), a vinyl-substituted alkyl group (e.g., allyl group), a cyanoalkyl group (e.g., 2-cyanoethyl), a carbamoylalkyl group (e.g., 2-carbamoylethyl), an aryloxyalkyl group (e.g., 2-phenoxyethyl and 3-phenoxypropyl), an aralkyl group (e.g., 2-phenetyl and 3-phenylpropyl), or an aryloxyalkyl group (e.g., 2-phenoxyethyl and 3-phenoxypropyl). Of these substituted alkyl groups, an aralkyl group is preferred.

The charge balancing ion shown by $X_0$ is an optional anion capable of neutralizing the positive charges formed by the quaternary ammonium salt in the heterocyclic ring, and examples thereof are bromide ions, chloride ions, iodide ions, p-toluenesulfonate ions, ethylsulfonate ions, perchlorate ions, trifluoromethanesulfonate ions, and thiocyanate ions. In this case, n is 1.

When one of $R^{11}$ and $R^{12}$ in formula (I) contains an anion substituent such as sulfoalkyl substituent, the compound of (I) may be bentane and in this case the balancing ion is unnecessary and n is 0. When $R^{11}$ and $R^{12}$ each has an anion substituents, such as a sulfoalkyl group respectively, X is a cationic ion, such as alkali metal ions (sodium ions, potassium ions, etc.) and ammonium salt ions (such as triethylammonium ions).

In this invention the terminology having substantially no absorption maximum in the visible region of the spectrum" means a compound resulting in no color, or such a limited degree of color the photographic light-sensitive material, that no problems exist for practical use. More specifically, the compound the residual color of which after photographic processing has a tone below the level of causing no practical problem.

It is preferred that the absorption maximum of the compound in methanol is at a wavelength region of shorter than 460 n.m., and more particularly shorter than 430 n.m.

Some, specific examples of compounds represented by formula (I) are illustrated below, but the invention is not limited to these compounds.

I-1
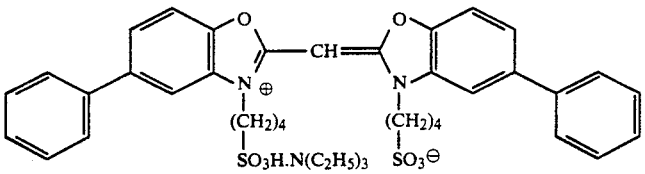
I-2
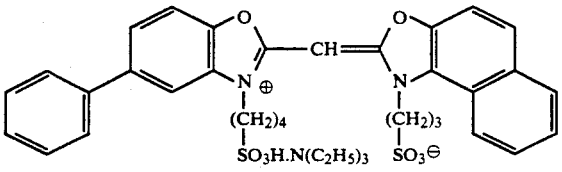
I-3
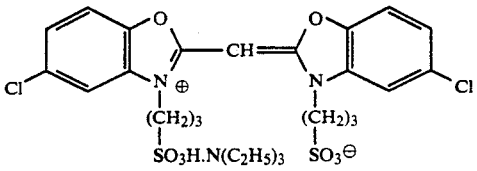
I-4
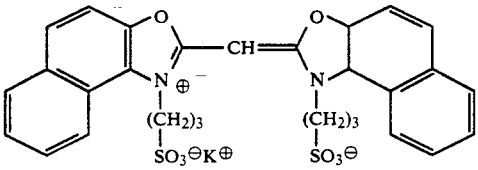
I-5
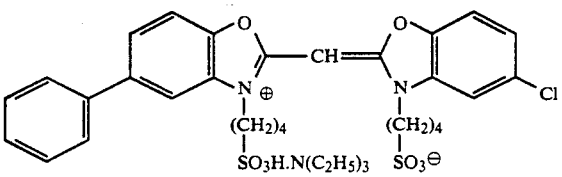
I-6
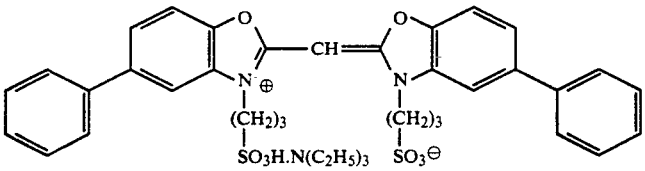
I-7
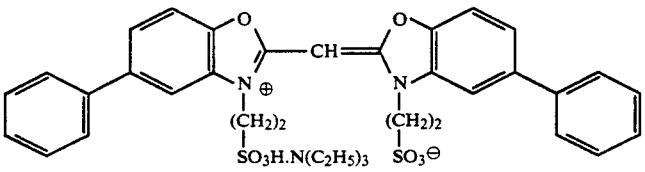
I-8
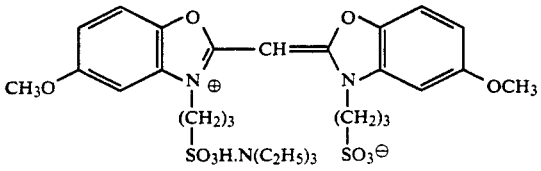

-continued
I-9
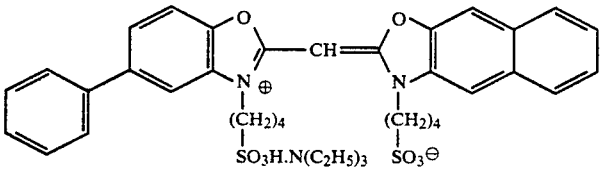
I-10
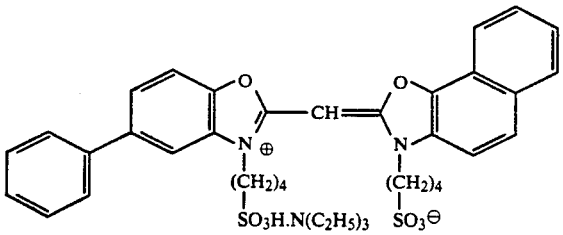
I-11
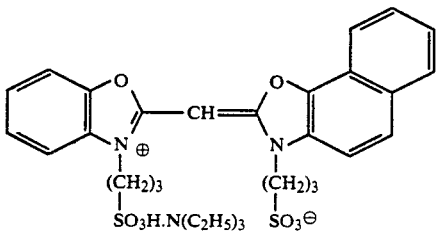
I-12
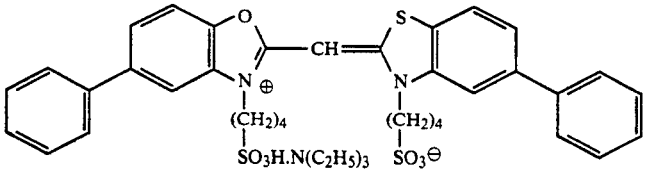
I-13
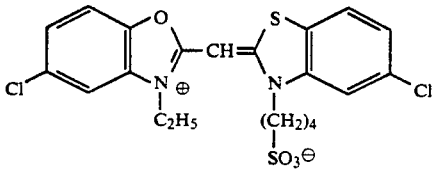
I-14
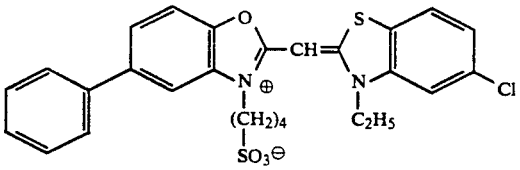
I-15
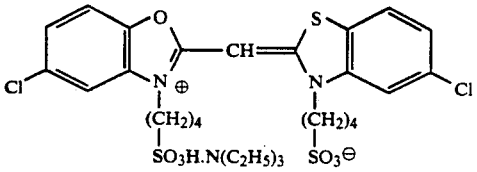
I-16
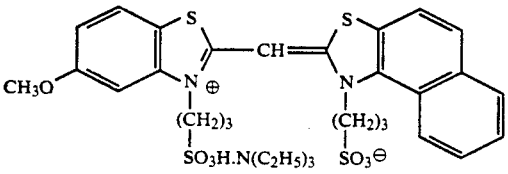

-continued
I-17
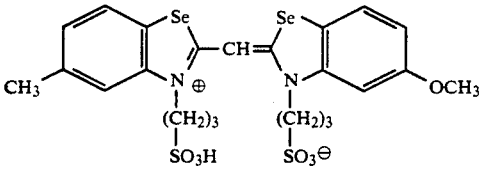
I-18
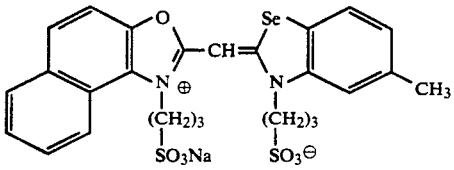
I-19
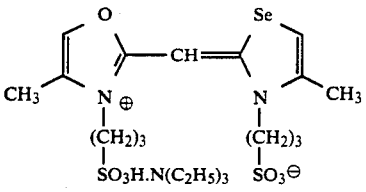
I-20
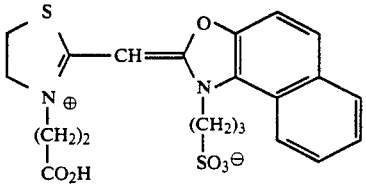
I-21
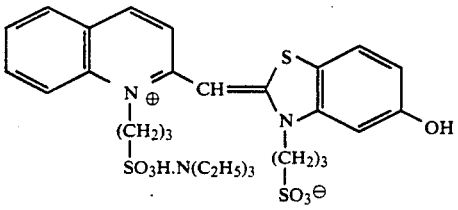
I-22
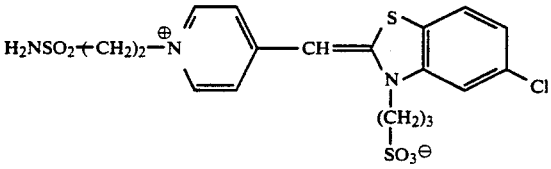
I-23
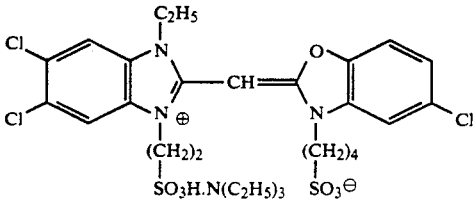

-continued

I-24

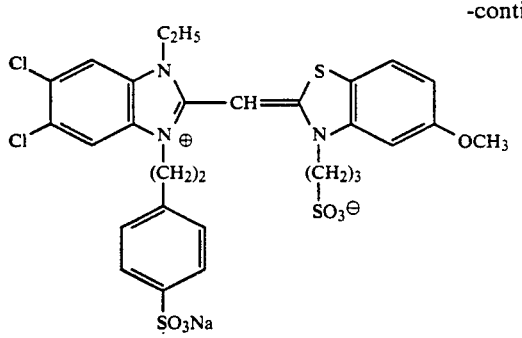

I-25

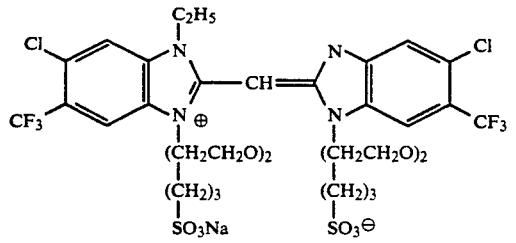

I-26

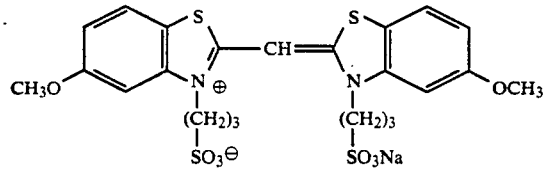

Next, the hydrazine compound by formula (II) described above is explained in further detail below.

In formula (II), the aliphatic group shown by $R_1$ is a straight, branched or cyclic alkyl group, an alkenyl group or an alkynyl group. These groups preferably have up to 30 carbon atoms (not including the number of carbon atoms of substituents if any).

The aromatic group shown by $R_1$ is a monocyclic or bicyclic aryl group preferably having up to 12 carbon atoms (not including the number of carbon atoms of substituents if any), such as phenyl, naphthyl, etc.

The heterocyclic ring shown by $R_1$ is a 3- to 10-membered saturated or unsaturated heterocyclic ring having at least one of a nitrogen atom, an oxygen atom, and a sulfur atom, preferably having up to 9 carbon atoms (not including the number of carbon atoms of substituents if any), and the ring may be a single ring or form a condensed ring with other aromatic ring or heterocyclic ring. The heterocyclic ring is preferably a 5- or 6-membered aromatic heterocyclic ring, such as pyridine, imidazolyl, quinolinyl, benzimidazolyl, pyrimidine, pyrazolyl, isoquinolinyl, thiazolyl, benzothiazolyl, etc.

The groups represented by $R_1$ may be substituted by a substituent such as, e.g., an alkyl group, an aralkyl group, an alkoxy group, an aryl group, a substituted amino group, an amylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, and a carboxy group.

The aforesaid substituent may be further substituted.

These groups may combine with each other to form a ring.

$R_2$ in formula (II) is preferably as follows.

When $G_1$ is a carbonyl group, $R_2$ is preferably a hydrogen atom, an alkyl group (e.g., methyl, trifluoromethyl, 3-hydroxypropyl and 3-methanesulfoamidopropyl), an aralkyl group (e.g., o-hydroxybenzyl), or an aryl group (e.g., phenyl, 3,5-dichlorophenyl, o-methanesulfonamidophenyl, and 4-methylsulfonylphenyl), and is particularly preferably a hydrogen atom.

When $G_1$ is a sulfonyl group, $R_2$ is preferably an alkyl group (e.g , methyl), an aralkyl group (e.g., o-hydroxyphenylmethyl), an aryl group (e.g., phenyl), or a substituted amino group (e.g., dimethylamino).

When $G_1$ is a sulfoxy group, $R_2$ is preferably a cyanobenzyl group or a methylthiobenzyl group.

When $G_1$ is a phosphoryl group, $R_2$ is preferably a methoxy group, an ethoxy group, a butoxy group, a phenoxy group, or a phenyl group, and is particularly preferably a phenoxy group.

When $G_1$ is an N-substituted or unsubstituted iminomethylene group, $R_2$ is preferably a methyl group, an ethyl group, or an unsubstituted or substituted phenyl group.

When $R_2$ is a substituted group, examples of the substituent are, in addition to the substituents illustrated above in regard to the substituents for $R_1$, an acyl group, an acyloxy group, an alkyoxycarbonyl group, an aryloxycarbonyl group, an alkenyl group, an alkynyl group, and a nitro group.

These substituents may be further substituted, and may combine with each other to form a ring.

At least one of $R_1$ and $R_2$ has an adsorption accelerating group to silver halide, and the adsorption accelerating group can be shown by $X_1$-$(L_1)_m$—, wherein $X_1$ represents an adsorption accelerating group with respect to silver halide; $L_1$ represents a divalent linking group; and m represents 0 or 1.

Preferred examples of the adsorption accelerating group with respect to silver halide represented by $X_1$ are a thioamido group, a mercapto group, a group having a disulfido bond, a 5- or 6-membered nitrogen-containing heterocyclic group.

The thioamido adsorption accelerating group represented by Xl is a divalent group represented by $$-\overset{\overset{\displaystyle S}{\|}}{C}\text{-amino-},$$

which may be apart of a cyclic structure or a noncyclic thioamido group.

Examples of the useful thioamido adsorption accelerating group are described in U.S. Pat. Nos. 4,030,925, 4,031,127, 4,080,207, 4,245,037, 4,255,511, 4,266,013, and 4,276,364, Research Disclosure, No. 15162 (November, 1976) and ibid., Vol. 176, No. 17626 (December, 1978).

Specific examples of the noncyclic thiamido group represented by $X_1$ are thiureido, thiourethane, and dithiocarbamic acid ester. Also, specific examples of the cyclic thioamido group represented by $X_1$ are 4-thiazoline-2-thione, 4-imidazoline 2-thione, 2-thiohydantoin, rhodanine, thiobarbituric acid, tetrazoline-5-thione, 1,2,4 triazoline-3-thione, 1,3,4-thiadiazoline-2-thione, 1,3,4-oxadiazoline-2-thione, benzimidazoline-2-thione, benzoxazoline-2-thione, and benzothiazoline-2-thione. These groups may be further substituted.

Examples of the mercapto group represented by $X_1$, include an aliphatic mercapto group, an aromatic mercapto group, and a heterocyclic mercapto group (when the group adjacent to the carbon atom to which —SH is bonded is a nitrogen atom, the mercapto group has the same significance as a cyclic thioamido group, being in a tautomer relation therewith, and specific examples of the group are the same as illustrated above).

Examples of the 5- or 6-membered nitrogen-containing heterocyclic group represented by $X_1$ include a 5- or 6-membered nitrogen-containing heterocyclic group composed of a combination of nitrogen, oxygen, sulfur and carbon, and specific examples thereof are benzotriazole, triazole, tetrazole, imidazole, benzimidazole, imidazole, benzothiazole, thiazole, benzoxazole, oxazole, thiadiazole, oxadiazole, and triazine. They may further be substituted by a substituent such as those described above as the substituents for $R_1$.

$X_1$ in formula (II) is preferably a cyclic thioamido group (e.g., a mercapto-substituted nitrogen-containing heterocyclic ring, e.g., 2-mercaptothiadiazole, 3-mercapto-1,2,4-triazole, 5-mercatptetrazole, 2-mercapto-1,3,4-oxadiazole, and 2-mercaptobenzoxazole) or a nitrogen-containing heterocyclic group (e.g., benzotriazole, benzimidazole, and indazole).

Also, two or more groups represented by $X_1$—$(L_1)_m$— may exist, and, in this case, they may be the same or different.

The divalent linkage group shown by $L_1$ is an atom or atomic group containing at least one of C, N, S, and O. Specific examples of the divalent linkage group are an alkylene group, an alkenylene group, an alkinylene group, an arylene group, —O—, —S—, —NH—, —N=,—CO—, and —$SO_2$—, singly or as a combination thereof.

Specific examples of the divalent linkage group are illustrated as follows;

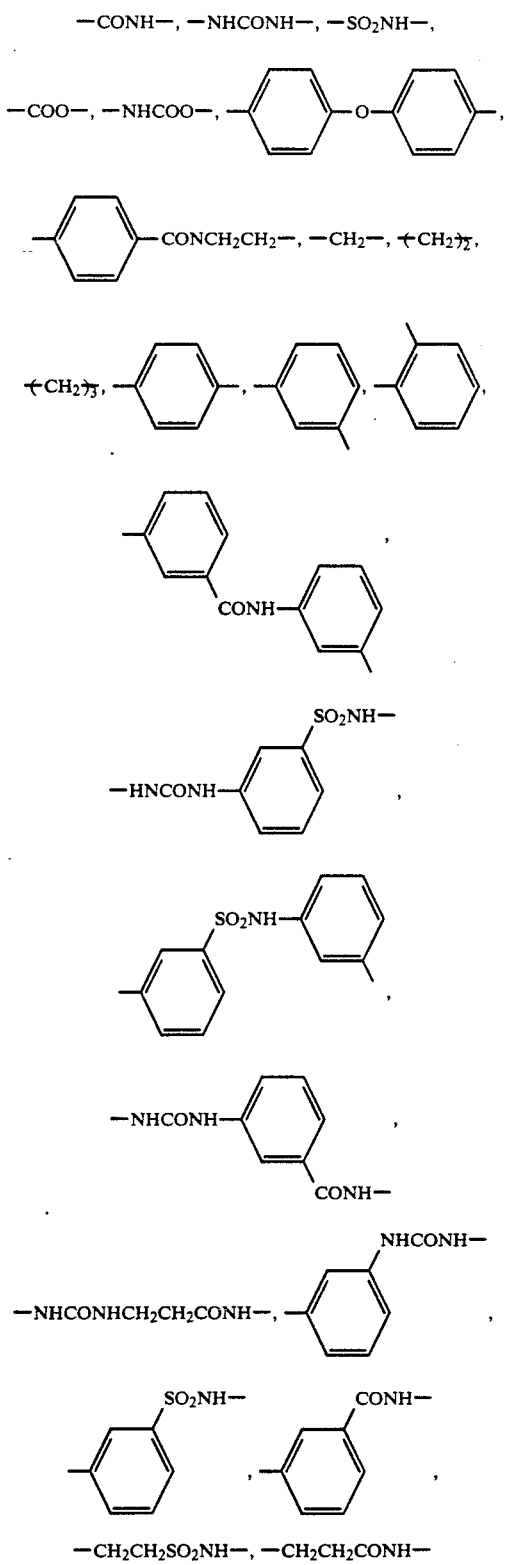

These groups may be substituted by a proper substituent such as the substituent as described above as the substituent for $R_1$.

In formula (II), $A_1$ and $A_2$ each is a hydrogen atom, an alkylsulfonyl group having from 1 to 20 carbon atoms, an arylsulfonyl group having from 6 to 20 carbon atoms (preferably a phenylsulfonyl group or a phenylsulfonyl group substituted so that the sum of the Hammett's substituent constants becomes at least −0.5), or an acyl group having from 1 to 20 carbon atoms (preferably a benzoyl group or a benzoyl group substituted so that the sum of the Hammett's substituent constants is at least −0.5, or a straight chain, branched, or cyclic unsubstituted or substituted aliphatic acyl group.) Examples of the substituent are a halogon atom, an ether group, a sulfonamido group, a carbonamido group, a hydroxy group, a carboxy group, and a sulfonic acid group).

The sulfinic acid group represented by $A_1$ and $A_2$ is described is U.S. Pat. No. 4,478,928.

$A_1$ and $A_2$ are most preferably a hydrogen atom.

In formula (II), $G_1$ is most preferably a carbonyl group.

The preferred hydrazine compound represented by formula (II) described above can be represented by formula (III)

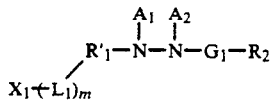

(III)

wherein the groups $A_1$, $A_2$, $R_2$, and $G_1$ are the same as defined for formula (II); $R_1'$ has the same meaning as $R_1$ of formula (II) except omitting therefrom one hydrogen atom, $X_1$, $L_1$, and m are the same as defined above; and at least one of $R'_1$, $R_2$, and $L_1$ has a group capable of dissociating into an anion having a pKa of at least 6 or an amino group.

The aforesaid group capable of dissociating into an anion having a pKa of at least 6 is preferably a group capable of dissociating into an anion having a pKa of from 8 to 13, and such a group is not required to be a specific one, but may be a group which scarecely dissociates in a neutral or weak acid medium and sufficiently dissociates in an alkaline aqueous solution (preferably having a pH of from 10.5 to 12.3), such as a developer.

Examples of the aforesaid group are a hydroxy group, a group shown by $—SO_2HN—$, a hydroxyimino group

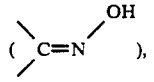

an active methylene group or an active methine group (e.g., $—CH_2COO—$, $—CH_2COO—$, $—CH_2CO—$, and

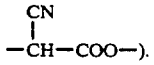

Also, the aforesaid amino group may be a primary, secondary or tertiary amino group, and is preferably an amino group having at least 6.0 in pKa of conjugate acid.

Also, a particularly preferred hydrazine compound represented by formula (III) is represented by formula (IV)

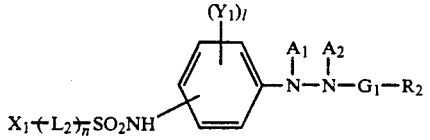

(IV)

wherein $A_1$, $A_2$, $G_1$, $R_2$, and $X_1$ have the same meanings as described above for formulae (II) and (III); $L_2$ has the same meaning as $L_1$ in formulae (III); $Y_1$ has the same meaning as described above as the substituents for $R_1$ of formula (II); n represents 0 or 1; and l represents 0, 1, or 2; and when l is 2, the two $Y_1$ groups may be the same or different.

Furthermore, it is preferred that $X_1—(L_2)_n—SO_2NH$ is substituted at the p-position to the hydrazino group.

Specific examples of the compound represented by formula (II) are illustrated below, but the compound for use in this invention is not limited to these compounds.

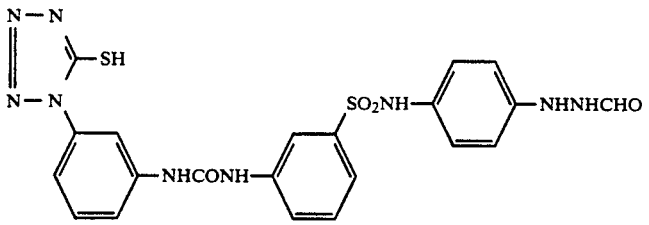

II-1

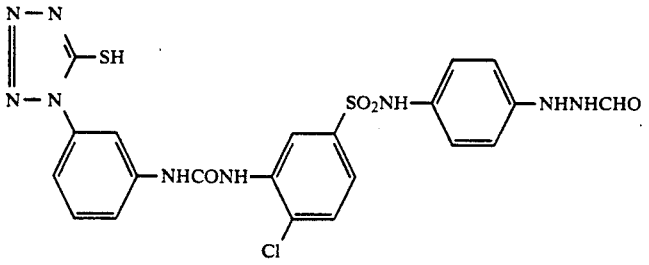

II-2

-continued
II-3
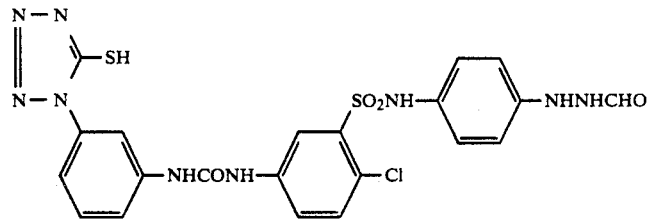
II-4
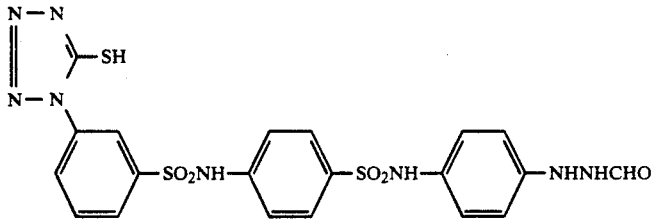
II-5
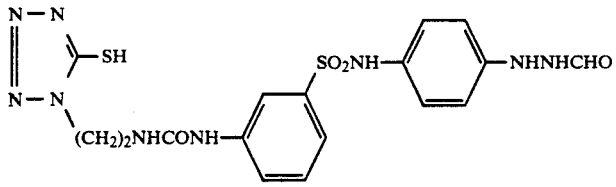
II-6
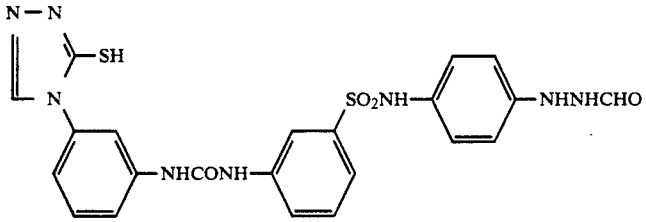
II-7
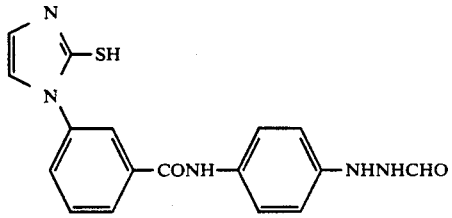
II-8
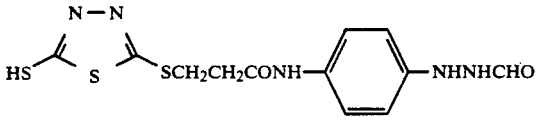
II-9
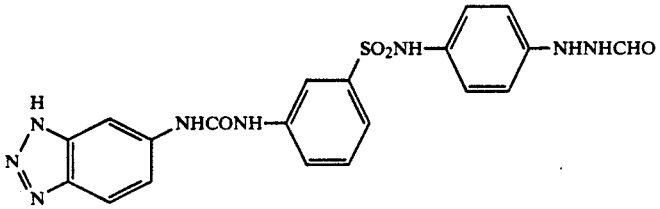
II-10
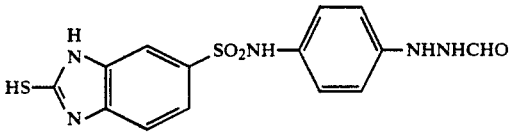

-continued
II-11
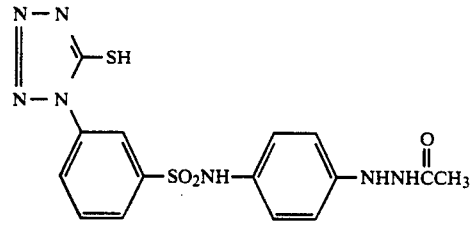
II-12
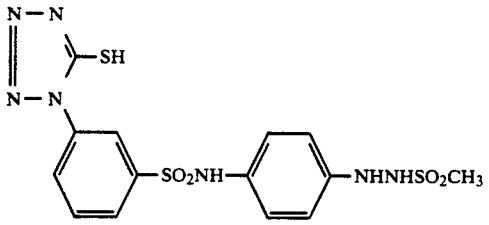
II-13
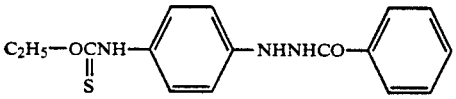
II-14
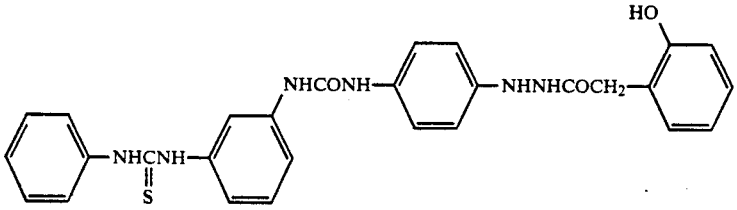
II-15
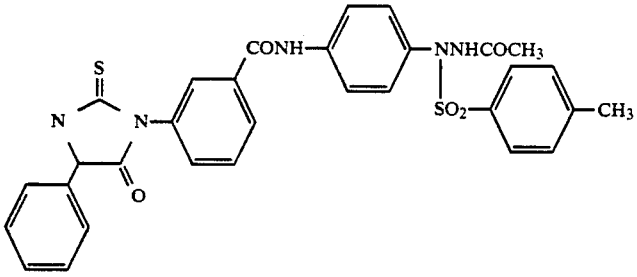
II-16
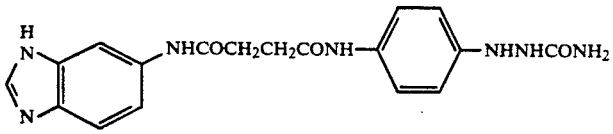
II-17
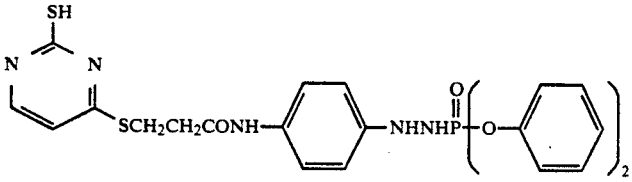
II-18
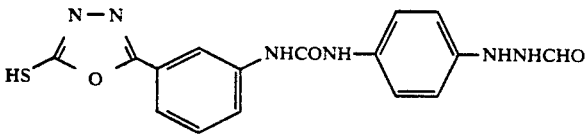

-continued
II-19
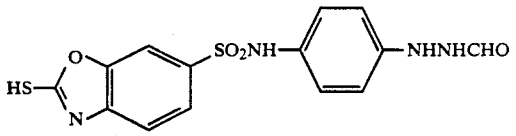
II-20
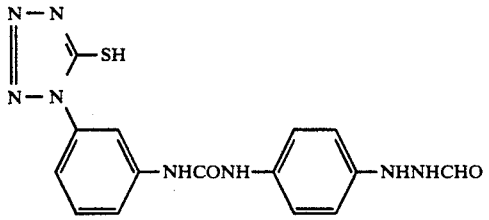
II-21
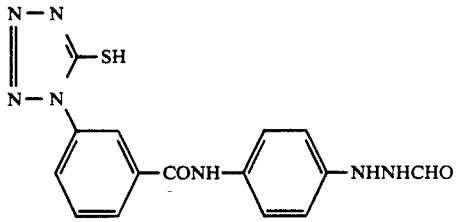
II-22
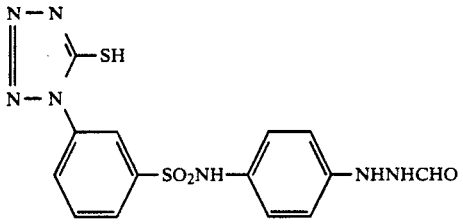
II-23
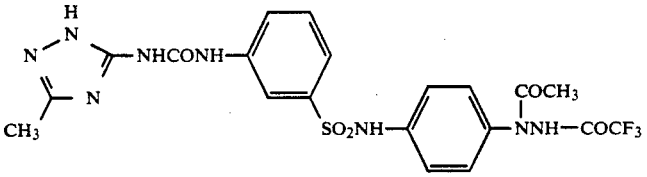
II-24
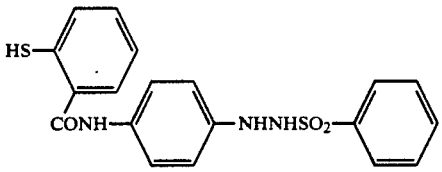
II-25
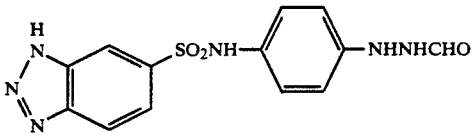
II-26
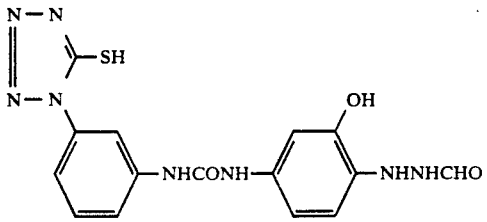

-continued
II-27
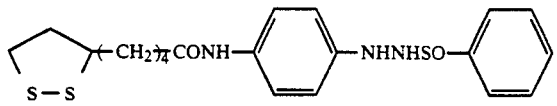
II-28
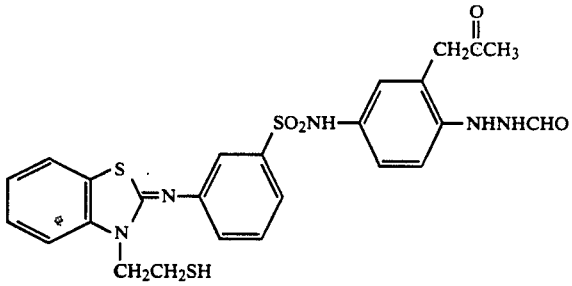
II-29
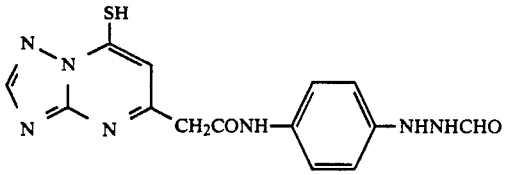
II-30
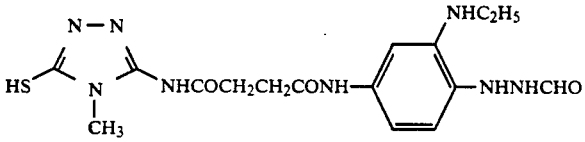
II-31
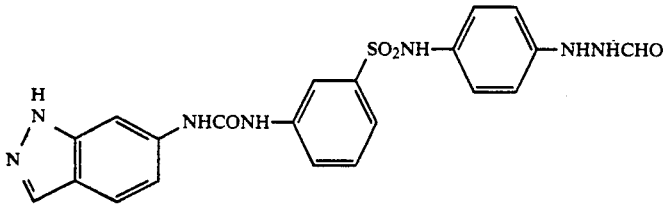
II-32
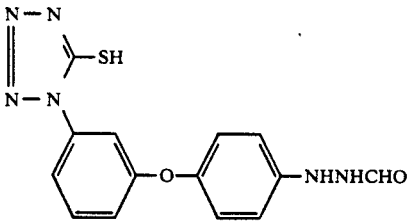
II-33
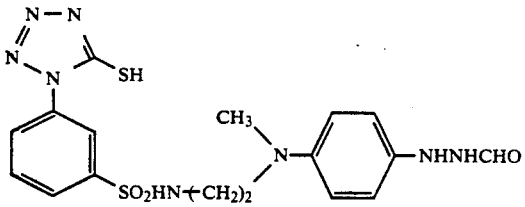
II-34
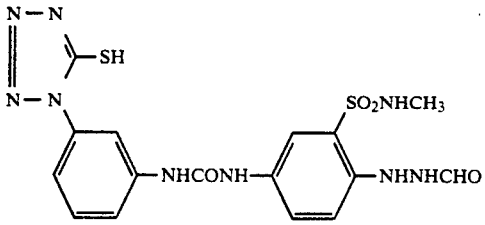

-continued

II-35

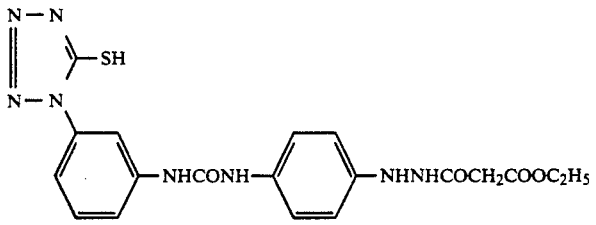

In this invention, in addition to the hydrazine compound having an adsorptive group shown by formula (II) described above, a hydrazine compound having no adsorptive group can be, if necessary, used together therewith. For example, the following hydrazine compound can be used together with the hydrazine compound of formula (II) in an amount of from 0.5 to 50 times, and preferably from 1 to 10 times by mole ratio the amount of the hydrazine compound of formula (II).

V-1)

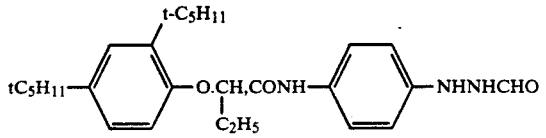

V-2)

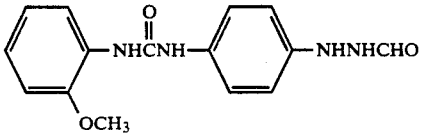

V-3)

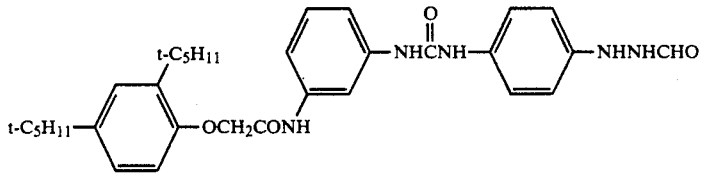

V-4)

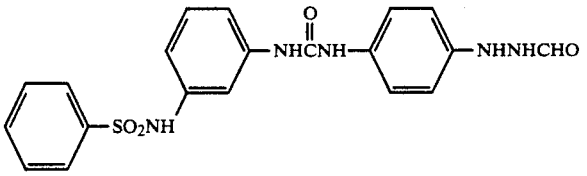

V-5)

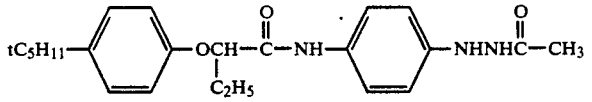

V-6)

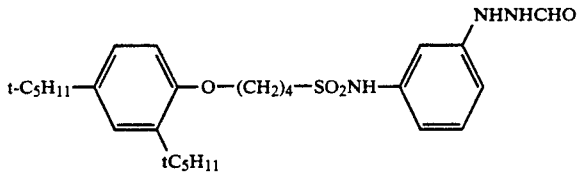

V-7)

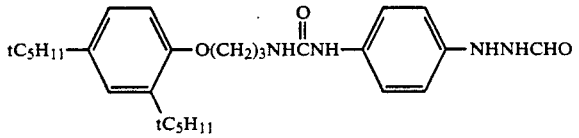

-continued

V-8)

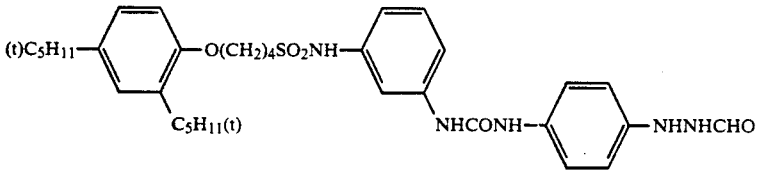

In this invention, when the compound represented by formula (I) and the hydrazine derivative represented by formula (II) are incorporated in a photographic light-sensitive material, it is preferred that they are incorporated in the silver halide emulsion layer thereof, but they may also exist in a light-insensitive hydrophilic colloid layer (e.g., protective layer, interlayer, filter layer, and antihalation layer).

Practically, when the compound for use is soluble in water, the compound may be added to the hydrophilic colloid solution as an aqueous solution thereof, and when the compound is sparingly soluble in water, the compound may be added to the hydrophilic colloid solution as a solution in an organic solvent miscible with water, such as alcohols, esters, ketones, etc. (e.g., methanol, ethanol, propanol, fluorinated alcohols, acetone, methyl ethyl ketone, dimethylformamide, tetrahydrofuran, and methyl cellosolve).

In the case of adding the aforesaid compounds to the silver halide emulsion layer, they may be added to the emulsion at any time from the beginning of chemical ripening and before coating, but is preferably added at a step between the completion of chemical ripening and before coating. In particular, it is preferred that these compounds are added to a coating composition before coating.

It is preferred that the content of the compound represented by formula (I) is properly selected according to the grain size and the halogen composition of the silver halide emulsion, the method and extent of the chemical sensitization applied to the silver halide emulsion, the relation between the layer in which the compound is incorporated and silver halide emulsion, the nature of an antifoggant being employed, etc. The amount of the compound is preferably in the range of from $10^{-6}$ to $10^{-2}$ mole, and particularly preferably from $10^{-5}$ to $5\times10^{-3}$ mole, per mole of silver halide.

In this invention the hydrazine compound represented by formula (II) can be added by the same manner as the case of adding the compound of formula (I) described above, and the addition amount thereof is preferably from $10^{-6}$ to $10^{-1}$ mole, and particularly preferably from $10^{-5}$ to $4\times10^{-3}$ mole, per mole of silver halide.

In the case of using the hydrazine compound having an adsorptive group as in formula (II), it is preferred to use together therewith a certain kind of a development accelerator.

The development accelerators or the accelerators for nucleating infectious developers preferable for use in this invention are practically the compounds disclosed in JP-A-53-77616, 54-37732, 53-137133, 60-140340, 60-14959, etc. (the term "JP-A" as used herein means an "unexamined published patent application"). Furthermore, various compounds containing nitrogen or sulfur can be effectively used as the accelerators.

Specific examples of these accelerators are set forth below.

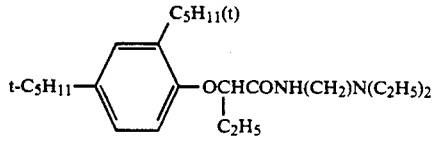

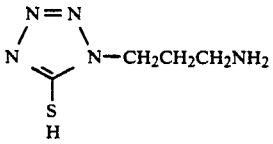

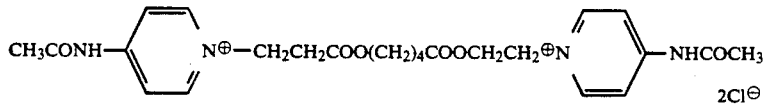

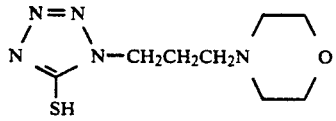

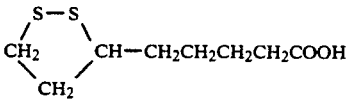

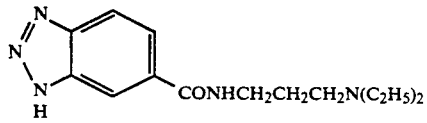

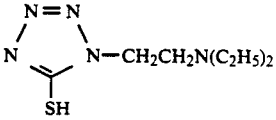

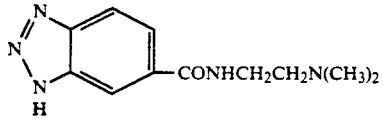

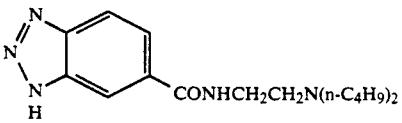

-continued

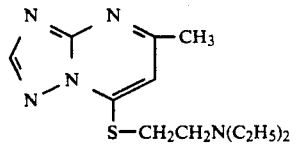

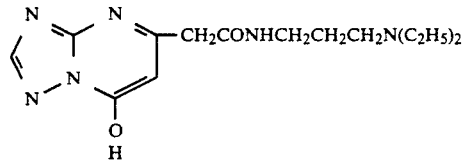

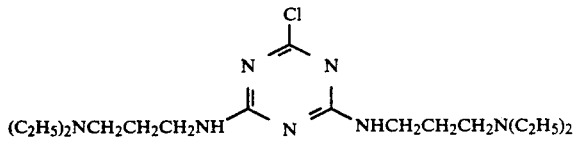

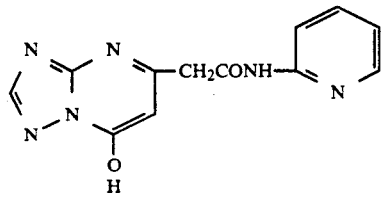

$(C_2H_5)_2NCH_2CH(OH)CH_2OH$

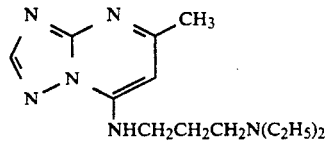

$n\text{-}C_4H_9N(C_2H_4OH)_2$

The optimum amount of the accelerator differs according to the kind of the compound, but is usually from $10^{-3}$ to 0.5 g/m$^2$, and preferably from $5.0\times10^{-3}$ to 0.1 g/m$^2$. The accelerator is added to a coating composition as a solution in a proper solvent such as water, alcohols (e.g., methanol and ethanol), dimethylformamide, methyl cellosolve, etc. These accelerators may be used singly or as a mixture thereof.

The silver halide for use in this invention may be silver chloride, silver chlorobromide, silver iodobromide, silver iodochloro-bromide, etc., and preferably silver iodobromide. The content of silver iodide in the silver halide is less than 10 mole %, and is particularly preferably from 0.4 to 3.5 mole %.

The silver halide grains for use in this invention are preferably fine grains (e.g., less than 0.7 μm in mean grain size) and in particular, the silver halide grains having a mean grain size of less than 0.5 μm are particularly preferred.

There is no particular restriction on the grain size distribution, but a monodispersed silver halide emulsion is preferred. The term "mono-dispersed" means that the silver halide emulsion is composed of silver halide grains at least 95% by weight or by number of which are within ±40% of the mean grain size.

The silver halide grains in the photographic emulsion for use in this invention may have a regular crystal form such as cubic, octahedral, tetrahedral, rhombic dodecahedral, etc., and particularly preferably have a form of cubic or tetrahydral. Also, the silver halide grains may have a irregular crystal form such as spherical form, tabular form having an aspect ratio of from 3 to 20, etc., or they may have a composite form of the aforesaid crystal forms.

The silver halide grains may have a uniform phase throughout the grain or may have a different phase between the inside and the surface portion thereof. Also, a mixture of two or more kinds of silver halide emulsions separately prepared may be used.

In the silver halide emulsion for use in this invention may exist a cadmium salt, a sulfite, a lead salt, a thallium salt, a rhodium salt or a complex salt thereof, an iridium salt or a complex salt thereof, etc., in the step of the formation or the physical ripening of the silver halide grains.

A silver halide particularly preferable for use in this invention is a silver haloiodide prepared in the existence of $10^{-3}$ to $10^{-5}$ mole of an iridium salt or a complex salt thereof per mole of silver, wherein the silver iodide content at the surface of the grain is large than the mean silver iodide content of the grains. By using the emulsion containing such a silver haloiodide, the photographic characteristics having higher sensitivity and a high gamma are obtained.

In this case it is preferred that the aforesaid amount of an iridium salt is added to a silver halide emulsion before finishing the physical ripening, in particular during the formation of silver halide grains in the production step for the emulsion.

The iridium salt for use in this case is a water-soluble iridium salt or iridium complex salt, such as, for example, iridium trichloride, iridium tetrachloride, potassium hexachloroiridate(III), potassium hexachloroiridate (IV), and ammonium hexachloroiridate (III).

The silver halide photographic material of this invention may contain a single silver halide emulsion or a mixture of two or more kinds of silver halide emulsions (e.g., emulsions having different mean grain sizes, different halogen compositions, different crystal havits, or produced by different conditions for chemical sensitization.

In the case of using two or more kinds of emulsions, it is preferred in the point of increasing the maximum density (Dmax) to use two kinds of mono-dispersed emulsions having different mean grain sizes as disclosed in JP-A-61-223734 and 62-90646.

In the aforesaid case it is preferred that the mono-dispersed emulsion having small silver halide grains is chemically sensitized, and as the chemical sensitization method, a sulfur sensitization is most preferred.

The large grain mono-dispersed emulsion may not be chemically sensitized but may be chemically sensitized.

A large size mono-dispersed silver halide emulsion is generally not chemically sensitized since the emulsion is liable to form black pepper spots but if the emulsion is chemically sensitized, it is particularly preferred to shallowly apply it to an extent of not causing black pepper spots. The term "shallowly applying chemical sensitization" means that the application time of chemical sensitization is shortened, the application temperature is lowered, and/or the amount of the chemical sensitizer is reduced as compared to the case of chemically sensitizing a small size mono-dispersed emulsion.

There is no particular restriction on the sensitivity difference between the large size mono-dispersed emulsion and the small size mono-dispersed emulsion, but log E (E: an exposure amount) is from 0.1 to 1.0, and more preferably from 0.2 to 0.7, and it is preferred that the sensitivity of the large size mono-dispersed emulsion is higher.

Also, the silver halide emulsion layer may be composed of a single layer or plural layers (2 layers, 3 layers, etc.). In the case of plural layers, different silver halide emulsions may be used for the layers, respectively, or the same kind of silver halide emulsion may be used for those layers.

As the binder or protective colloid for the photographic emulsion, gelatin is advantageously used, but other hydrophilic colloids can also be used. For example, there are gelatin derivatives, graft polymers of gelatin and other polymers, proteins such as albumin, casein, etc.; cellulose derivatives such as hydroxyethyl cellulose, carboxymethyl cellulose, cellulose sulfuric acid ester, etc.; saccharide derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, limed gelatin as well as acid-treated gelatin, gelatin hydrolyzed products, or gelatin enzyme decomposition products can be used.

The emulsion of this invention is chemically sensitized and as the chemical sensitization method, a sulfur sensitization method, a reduction sensitization method, a gold sensitization method, etc., can be used, solely or as a combination thereof. The preferred chemical sensitization is sulfur sensitization.

As the sulfur sensitizer, sulfur compounds contained in gelatin as well as various sulfur compounds, such as thiosulfates, thioureas, thiazoles, rhodanines, etc, can be used. Preferred sulfur compounds are thiosulfates and thiourea compounds. The pAg at the chemical sensitization is in the range of preferably less than 8.3, and more preferably from 7.3 to 8.0. More preferably, the use of polyvinylpyrrolidone and a thiosulfate together gives good results, as reported by Moissar and Klein, *Gelatin Proc. Symp.*, 2nd, 301-309(1970).

A gold sensitization method is a typical noble metal sensitization method, and a gold complex salt is mainly used for the sensitization method. In other noble metal sensitization method a complex salt of a noble metal other than gold, such as platinum, palladium, iridium, etc., may be used. Practical examples of the noble metal sensitization are described in U.S. Pat. No. 2,448,060 and British Patent 618,061.

As the reduction sensitizer, stannous salts, amines, formamidinesulfinic acid, silane compounds, etc., can be used.

In this invention sensitizing dyes (e.g., cyamine dyes, merocyanine dyes, etc.,) having the absorption maximum at the visible region described in JP-A-55-52050, pages 45-53 can be added to the silver halide emulsions, whereby the specific sensitivity region of silver halide can be shifted to a longer wavelength size by spectral sensitization.

These sensitizing dyes may be used singly or as a combination thereof, and a combination of these sensitizing dyes is frequently used for the purpose of super color sensitization.

The silver halide emulsion may further contain, together with the sensitizing dye(s), a dye having no spectral sensitizing activity by itself, or a material which does not substantially absorb visible light and shows a super color sensitization.

Useful sensitizing dyes, a combination of dyes showing super color sensitization, and materials showing super color sensitization are described in *Research Disclosure*, Vol. 176, No. 17643 (December, 1978).

The above *Research Disclosure*, under "J" in § IV on page 23 mentions as among useful spectral sensitizing dyes for sensitizing silver halide emulsions those found in U.K. Patent 742,112, U.S. Pat. No. 2,078,233 to Brooker and U.S. Pat. No. 3,506,443 to Motter, among others.

U.K. Patent 742,112 discloses sensitizing dyes of formula (XI), U.S. Pat. No. 2,078,233 to Brooker discloses sensitizing dyes of formulae (XII) and (XIII) and U.S. Pat. No. 3,506,433 to Motter discloses dyes of formulae (XIV) and (XV) as set forth below.

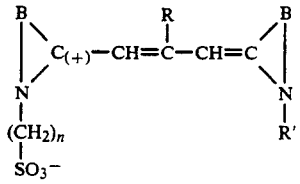

(XI)

in which B together with the adjacent C atom and N atom represents a heterocyclic residue, n represents a positive integer of at least 3 but not more than 18, the $CH_2$ group may be substituted, and R and R' represent a substituted or unsubstituted alkyl radical;

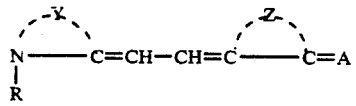

(XII)

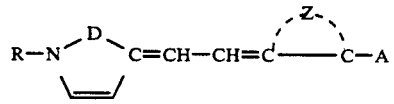

(XIII)

wherein A represents an atom selected from the group consisting of oxygen and sulfur, D represents a phenylene group, R represents an alkyl group, and Y and Z represent the non-metallic atoms necessary to complete a heterocyclic nucleus selected from the group consisting of five-membered and six-membered heterocyclic nuclei;

(XIV)

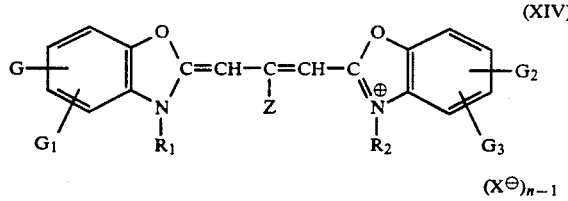

$(X^{\ominus})_{n-1}$ wherein G and $G_3$ each represents a group selected from the group consisting of a halogen atom, a hydroxyl group, an alkoxy group, an amino group, an acylamino group, an acyloxy group, a carbalkoxy group, an alkoxycarbamylamino group, and a phenyl group, such that not more than one of G and $G_3$ each represents a phenyl group; $G_1$ and $G_2$ each represents a group selected from the group consisting of a hydrogen atom and a halogen atom; $R_1$ represents an alkyl group, a carboxyalkyl group or a sulfoalkyl group; $R_2$ represents an alkyl group, a carboxyalkyl group or a sulfoalkyl group; Z represents a group selected from the group consisting of a hydrogen atom, an alkyl group and an aryl group; and X represents an acid anion; n represents an integer of from 1 to 2, such that the n represents the integer 1 when at least one of $R_1$ and $R_2$ represents a group selected from the group consisting of a sulfoalkyl group and a carboxyalkyl group; and (XV)

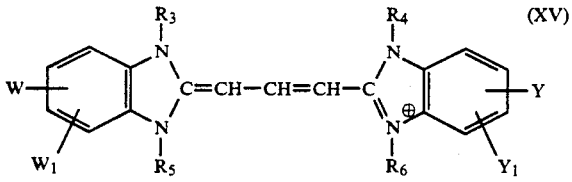

$(X_1^{\ominus})_{m-1}$ wherein W and Y each represents a group selected from the group consisting of a hydrogen atom, a halogen atom, an alkoxy group, an amino group, an acylamino group, an acyloxy group, and an alkoxycarbonylamino group; $W_1$ and $Y_1$ each represents a group selected from the group consisting of a hydrogen atom and a halogen atom; $R_3$ represents an alkyl group; $R_4$ represents an alkyl group; $R_5$ and $R_6$ each represents a group selected from the group consisting of an alkyl group, a sulfoalkyl group and a carboxyalkyl group; and $X_1$ represents an acid ion; and m represents the integer 1 when at least one of $R_5$ and $R_6$ represents a group selected from the group consisting of a sulfoalkyl group and a carhboxyalkyl group.

The silver halide photographic materials of this invention may contain various compounds for preventing the formation of fog during the production, storage and/or photographic processing of the photographic materials or for stabilizing the photographic performance thereof For examples, there are various compounds known as antifoggant or stabilizer, e.g., azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, etc.; mercaptopyridimies; mercaptotriazines; thioketo compounds such as oxazolinethione, etc.; azaindenes such as triazaindenes, tetraazaindenes (in particular, 4-hydroxysubstituted (1,3,3a,7)-tetraazaindenes), pentaazaindenes, etc.; benzenethio-sulfonic acid, benzenesulfinic acid, and benzenesulfonic acid amide.

In the aforesaid materials, benzotriazoles (e.g., 5-methyl-benzotriazole) and nitroindazoles (e.g., 5-nitroindazole) are preferred. These compounds may be incorporated in processing solutions for processing the photographic materials of this invention.

The photographic light-sensitive materials of this invention may further contain developing agents such as hydroquinone derivatives, phenidone derivatives, etc., for the purposes of stabilizers, accelerators, etc.

The photographic light-sensitive materials of this invention may further contain inorganic or" organic hardening agents in the silver halide photographic emulsion layers or other hydrophilic colloid layers Examples of the hardening agent are chromium salts (chromium alum, etc.), aldehydes (formaldehyde, glutaraldehyde, etc.), N-methylol compounds (dimethylolurea, etc.), dioxane derivatives, active vinyl compounds (1,3,5-triacryloyl-hexahydro-s-triazine, 1,3-vinylsulfonyl-2-propanol, etc.), active halogen compounds (2,4-dichloro-6-hydroxy s-triazine, etc.), mucohalogenic acids (mucochloric acid, etc.), N-carbamoylpyridiniums (1-morpholinocarbonyl-3-pyridinio)methane sulfonate, etc.), haloamidinium salts (1-(1 chloro-1-pyridinomethylene)pyrrolidinium, 2-naphthalene sulfonate, etc.), etc. They can be used singly or as a combination thereof The photographic light-sensitive materials of this invention may further contain in the silver halide emulsion layers or other hydrophilic colloid layers various surface active agents for various purposes such as coating aid, static prevention, improvement of slidability, improvement of emulsified dispersion, sticking prevention, and improvement of photographic characteristics (e.g., development accleration, contrast increase, sensitization, etc.).

Examples of the surface active agents are nonionic surface active agents such as saponin (steroid series), alkylene oxide derivatives (e.g., polyethylene glycol, a polyethylene glycol/polypropylene glycol condensate, polyethylene glycol alkyl ethers, polyethylene glycol alkylaryl ethers, polyethylene glycol esters, polyethylene glycol sorbitan esters, polyalkylene glycol alkylamines, polyalkylene glycol alkylamides, and polyethylene oxide addition products of silicone), glycidol derivatives (e.g., alkenylsuccinic acid polyglycerides and alkylphenol polyglycerides), fatty acid esters of polyhydric alcohols, , etc.; anionic surface active agents having acid groups (such as carboxy, sulfo, phospho, sulfuric acid ester, phosphoric acid ester, etc.), such as alkylcarboxylates, alkylsulfonates, alkylbenzenesulfonates, alkylnaphthalenesulfonates, alkylsulfuric acid esters, alkylphosphoric acid esters, N-acryl-N-alkyltaurines, sulfosuccinic acid esters, sulfoalkylpolyoxyethylene alkylphenyl ethers, polyoxy-ethylenealkylphosphoric acid esters, etc.; amphoteric surface active agents such as amino acids, amino-alkylsulfonic acid esters, aminoalkylphosphoric acid esters, alkylbetaines, amine oxides, etc.; cationic surface active agents such as alkylamine salts, aliphatic or aromatic quaternary ammonium salts, heterocyclic quaternary ammonium salts (such as pyridinium, imidazolium, etc.), and phosphonium salts or sulfonium salts containing an aliphatic ring or a heterocyclic ring.

The surface active agent which is preferably used in this invention is the polyalkylene oxides having a molecular weight of from 600 to 30,000 described in JP-B-58-9412. The term "JP-B" as used herein means an "examined published Japanese patent application".

Also, in this invention, it is preferred to use the fluorine-containing surface active agents described in JP-A-60-80849 for static prevention.

The photographic light-sensitive materials of this invention may further contain in the photographic emulsion layers and/or other hydrophilic colloid layers a hydroquinone derivative releasing a development inhibitor in proportion of the density of images at development (i.e., so-called DIR hydroquinone).

Practical examples of these hydroquinone derivatives are described in U.S. Pat. Nos. 3,379,529, 3,620,746, 4,377,634, and 4,332,878, JP-A-49-129536, 54-67419, 56-153336, 56-153,342, 59-278853, 59-90435, 59-90436, and 59-138808.

The photographic light-sensitive materials of this invention may further contain in the photographic emulsion layers or other hydrophilic colloid layers a matting agent such as silica, magnesium oxide, polymethyl emthacrylate particles, etc., for the purpose of sticking prevention.

Furthermore, the photographic light-sensitive materials of this invention can further contain a dispersion of a water insoluble or water sparingly soluble synthetic polymer for the purpose of dimensional stability. Examples of such a polymer are polymers or copolymers of alkyl acrylate or methacrylate (hereafter collectively referred to as "(meth)acrylate") alkoxyalkyl (meth)acrylate, glycidyl (meth)acrylate, etc., singly or as a combination thereof, or a combination of the aforesaid monomer and acrylic acid, methacrylic acid, etc.

The photographic light-sensitive materials of this invention preferably contain 0.05 to 3 g/m$^2$ of a compound having an acid group in the photographic emulsion layers or other hydrophilic colloid layers. Examples of the compound having an acid group are organic acids (such as salicyclic acid, acetic acid, ascorbic acid, etc.) and polymers or copolymers having an acid monomer such as acrylic acid, maleic acid, phthalic acid, etc., as a recuring unit. As these compounds, the descriptions of JP-A-61 223834, 61-228437, 62-25745, 62-55642,and 62-220947 can be referred to.

In these compounds, ascorbic acid is particularly preferred as a low molecular weight compound and a water-dispersible latex of a copolymer composed of the aforesaid acid monomer such as acrylic acid and a crosslinkable monomer having two or more unsaturated groups, such as divinylbenzene is particularly preferred as a high molecular weight compound.

As the support for use in this invention, there are glass plates, cellulose acetate films, polyethylene terephthalate films, papers, baryta-coated papers, papers laminated with polyolefin (e.g., polyethylene, polypropylene, etc.), polystyrene films, polycarbonate films, metal sheets such as aluminum sheets, etc.

These supports may, if necessary, be subjected to a corona discharging treatment by a known method, and also, if necessary, subjected to a subbing treatment.

For obtaining the photographic characteristics having a super high contrast and a high sensitivity using the silver halide photographic material of this invention, a stable developer can be used without need of using a conventional infectious developer or a high alkaline developer having a pH of about 13 described in U.S. Pat. 2,419,975.

That is, the silver halide photographic material of this invention can provide negative images of a sufficiently super-high contrast using a developer containing at least 0.15 mole/liter of sulfite ions" as a preservative and having pH of from 10.5 to 12.3, and preferably from 11.0 to 12.0.

There is no particular restriction on the developing agent which is used for the developer for developing the photographic light-sensitive materials of this invention, but the developer preferably contains a dihydroxybenzene from the viewpoint of easily obtaining good dot image quality Also, a combination of a dihydroxybenzene and a 1-phenyl 3-pyrazolidone or a combination of a dihydroxybenzene and a p-aminophenol can be used.

Examples of the dihydroxybenzene developing agent for use in this invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. In these compounds, hydroquinone is particularly preferred.

Examples of the 1-phenyl-3-pyrazolidone or the derivatives thereof as the developing agent for use in this invention include 1-phenyl-3-pyrazolidone, 1-phenyl-4,4-dimethyl-4-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1.-p-tolyl-4,4-dimethyl-3-pyrazolidone.

Examples of the p-aminophenolic developing agent for use in this invention include N-methyl-p-aminophenol, p-aminophenol, N-(8-hydroxyethyl)-p-aminophenol, N-(4-hydroxyphenyl)glycine, 2-methyl-p-aminophenol, and p-benzylaminophenol and in particular N-methyl-p-aminophenol is preferred.

The developing agent is preferably used in the range of from 0.05 mole/liter to 0.8 mole/liter. Also, when the dihydroxybenzene is combined with the 1-phenyl-3-pyrazolidone or the p-aminophenol, it is preferred that the former is used in the range of from 0.05 mole/liter to 0.5 mole/liter and the latter is used in an amount of less than 0.06 mole/liter.

Examples of the sulfite for use as a preservative in this invention include sodium sulfite, potassium sulfite, lithium sulfite, ammonium sulfite, sodium hydrogensulfite, potassium metahydrogensulfite, and sodium formaldehyde-hydrogensulfite. The amount of the sulfite is at least 0.4 mole/liter, and preferably at least 0.5 mole/liter. Also, the upper limit of the sulfite is preferably 2.5 moles/liter.

The developer in this invention further contains a pH controlling agent or buffer such as sodium hydroxide, potassium hydroxide, sodium carbonate, potassium carbonate, sodium tertiary phosphate, potassium tertiary phosphate, etc., as an alkali agent for adjusting the pH thereof. The pH of the developer is adjusted to be in the range of from 10 5 to 12.3.

The developer for use in this invention may further contain, in addition to the aforesaid components, additives such as boric acid, borax, etc.; development inhibitors such as sodium bromide, potassium bromide, potassium iodide, etc.; organic solvents such as ethylene glycol, diethylene glycol, triethylene glycol, dimethylformamide, methyl cellosolve, hexylene glycol, ethanol, methanol, etc.; and antifoggants or black pepper preventing agents, e.g., indazole series compounds such as 1-phenyl-5-mercaptotetrazole, 5-nitroindazole, etc., and benztriazole series compound such as 5-methylbenztriazole, etc.

Furthermore, if necessary, the developer may further contain a toning agent, a surface active agent, a defoaming agent, a water softener, a hardening agent, or the amino compounds described in JP-A-56-106244.

For the developer in this invention can be used the compounds described in JP-A-56-24347 as a silver stain preventing agent. Also, for the developer may be used the compounds described in JP-A-61-267759 as a dissolution aid for the developer Still further, for the developer may be also used the compound described in JP-A-60-93433 and the compounds described in JP-A-62-186259 as a pH buffer.

The photographic light-sensitive materials of this are fixed after development and an ordinary composition can be used for the fix solution.

As the fixing agent, thiosulfates, thiocyanates, and also organic sulfur compounds which are known to have an effect as a fixing agent can be used.

The fixing solution may further contain a water-soluble aluminum compounds (e.g., aluminum sulfate, aluminum alum, etc.) as a hardening agent. The amount of the water-soluble aluminum salt is usually from 0.4 to 2.0 g-Al/liter. Furthermore, for the fix solution there can be used a complex salt of a trivalent iron compound and ethylenediaminetetraacetic acid.

The processing temperature is selected in the range of from 18° C. and 50° C., and preferably from 25° C. to 43° C.

Then, the invention is further described based on the following examples.

In the examples, a developer having the following composition was used.

| Developer Composition | |
|---|---|
| Hydroquinone | 45.0 g |
| N-Methyl-p-aminophenol ½.sulfate | 0.8 g |
| Sodium hydroxide | 18.0 g |
| Potassium hydroxide | 55.0 g |
| 5-Sulfosalicyclic acid | 45.0 g |
| Boric acid | 25.0 g |
| Potassium sulfite | 110.0 g |
| Ethylenediaminetetraacetic acid. disodium salt | 1.0 g |
| Potassium bromide | 6.0 g |
| 5-Methylbenzotriazole | 0.6 g |
| n-Butyl-diethanolamine | 15.0 g |
| Water to make | 1 liter (pH 11.6) |

The development temperature and time were 34° C. and 20 seconds. In addition, the conditions for the evaluation of black pepper was 34° C. and 40 seconds.

EXAMPLE 1

To an aqueous gelatin solution kept at 50° C. were simultaneously added an aqueous solution of silver nitrate and an aqueous solution of potassium iodide and potassium bromide in the presence of $4\times10^{-7}$ mole of iridium hexachloroiridate(III) per mole of silver and ammonia over a period of 60 minutes while keeping the pAg of the system at 7.8 to provide a mono-dispersed emulsion containing cubic silver iodobromide grains having a mean grain size of 0.25 μm and a mean silver iodide content of 1 mole %. The emulsion was desalted by conventional flocculation.

To the emulsion was added $4.0\times10^{-4}$ mole of 5,5'-dichloro-9-ethyl-3,3'-bis(3-sulfopropyl) oxacarbocyanine sodium salt per mole of silver, and after adding thereto the compound of formula (I) and the compound of formula (II) for use in this invention as shown in Table 1 below and further adding thereto 20 mg/m$^2$ of Hydrazine Compound (V-1) having no adsorptive group, 4-hydroxy-6-methyl-1,3,3a,7-tetraazaindene, hydroquinone, a dispersion of polyethylene glycol (molecular weight of 1000) polyethyl acrylate, and 1,3-divinylsulfonyl-2-propanol, the emulsion was coated on a polyethylene terephthalate film at a silver coverage of 3.4 g/m$^2$. The coated amount of gelatin was 2 g/m$^2$.

On the emulsion layer was simultaneously coated a layer containing 1.3 g/m$^2$ of gelatin, 50 mg/m$^2$ of polymethyl methacrylate particles having a mean particle size of 2.5 μm, 0.15 g/m$^2$ of methanolsilica, and, as coating aids, the fluorine series surface active agent having the structure shown below and sodium dodecylbenzenesulfonate as a protective layer.

$$C_8F_{17}SO_2\underset{\underset{C_3H_7}{|}}{N}CH_2COOK$$

Each sample thus obtained was light-exposed and developed, and the photographic characteristics were evaluated as follows.

(1) The relative sensitivity was shown by the relative value of the reciprocal of the exposure amount giving density 1.5 in the development for 30 seconds at 34° C., the value of Comparison Sample a being defined as 100.

(2) The black pepper was evaluated by magnifying the visual region having a diameter of about 4 mm 25 times by a microscopic observation and counting the number of black pepper spots therein. Thus, the smaller the numeral value shows less the formation of black pepper spots.

The results obtained are shown in Table 1.

TABLE 1

| | Sample No. | | Compound of Formula (I) Kind | Compound of Formula (I) Amount (mole/mole-Ag) | Compound of Formula (II) Kind | Compound of Formula (II) Amount (mole/mole-Ag) | Photographic Performance Sensitivity | Photographic Performance Gradation (γ) | Photographic Performance Dmax | Black Pepper (number) |
|---|---|---|---|---|---|---|---|---|---|---|
| 1 | Com- | -a | — | — | II-1 | $3.5\times10^{-4}$ | 100 | 20 | 4.7 | 53 |
| 2 | parison | -b | — | — | II-20 | " | 95 | 15 | 3.7 | 70 |
| 3 | Sample | -c | — | — | II-21 | " | 93 | 13 | 3.5 | 63 |
| 4 | | -d | — | — | II-22 | " | 104 | 18 | 4.5 | 48 |
| 5 | | -e | — | — | II-25 | $7.5\times10^{-4}$ | 90 | 12 | 3.4 | 55 |
| 6 | Example | 1-1 | 1-3 | $2.0\times10^{-4}$ | II-1 | $3.5\times10^{-4}$ | 100 | 21 | 4.8 | 12 |
| 7 | | 1-2 | " | 4.0 | " | " | 98 | 20 | 4.5 | 7 |
| 8 | | 1-3 | 1-10 | 2.0 | " | " | 99 | 22 | 4.8 | 11 |
| 9 | | 1-4 | " | 4.0 | " | " | 95 | 20 | 4.6 | 5 |
| 10 | | 1-5 | 1-15 | 2.0 | " | " | 97 | " | 4.7 | 15 |

TABLE 1-continued

| Sample No. | | Compound of Formula (I) Kind | Amount (mole/mole-Ag) | Compound of Formula (II) Kind | Amount (mole/mole-Ag) | Photographic Performance Sensitivity | Gradation (γ) | Dmax | Black Pepper (number) |
|---|---|---|---|---|---|---|---|---|---|
| 11 | 1-6 | " | 4.0 | " | " | 94 | 18 | 4.6 | 9 |
| 12 | 1-7 | 1-26 | 2.0 | " | " | 96 | 19 | 4.5 | 18 |
| 13 | 1-8 | " | 4.0 | " | " | 90 | 17 | 4.1 | 10 |
| 14 | 1-9 | 1-3 | 2.0 | II-22 | " | 100 | 22 | 4.9 | 12 |
| 15 | 1-10 | " | 4.0 | " | " | 99 | 20 | 4.6 | 6 |
| 16 | 1-11 | 1-10 | 2.0 | " | " | " | " | 4.7 | 10 |
| 17 | 1-12 | " | 4.0 | " | " | 96 | 19 | 4.6 | 4 |
| 18 | 1-13 | 1-15 | $2.0 \times 10^{-4}$ | II-22 | $3.5 \times 10^{-4}$ | 97 | 21 | 4.7 | 14 |
| 19 | 1-14 | " | 4.0 | " | " | 95 | 20 | 4.6 | 7 |
| 20 | 1-15 | 1-26 | 2.0 | " | " | 97 | 19 | 4.6 | 19 |
| 21 | 1-16 | " | 4.0 | II-21 | " | 92 | 17 | 4.3 | 12 |
| 22 | 1-17 | 1-3 | 2.0 | " | " | 93 | 13 | 3.6 | 21 |
| 23 | 1-18 | " | 4.0 | " | " | 90 | 12 | 3.4 | 15 |
| 24 | 1-19 | 1-10 | 2.0 | " | " | 93 | 13 | 3.6 | 19 |
| 25 | 1-20 | " | 4.0 | " | " | 91 | 12 | 3.5 | 15 |
| 26 | 1-21 | 1-3 | 2.0 | II-20 | " | 95 | 14 | 3.6 | 21 |
| 27 | 1-22 | " | 4.0 | " | " | 93 | 13 | 3.5 | 16 |
| 28 | 1-23 | 1-10 | 2.0 | " | " | 95 | 15 | 3.8 | 19 |
| 29 | 1-24 | " | 4.0 | " | " | 94 | 13 | 3.5 | 14 |
| 30 | 1-25 | 1-3 | 2.0 | II-25 | $7.5 \times 10^{-4}$ | 89 | 14 | 3.6 | 27 |
| 31 | 1-26 | " | 4.0 | " | " | 86 | 11 | 3.2 | 20 |
| 32 | 1-27 | 1-10 | 2.0 | " | " | 89 | 14 | 3.5 | 24 |
| 33 | 1-28 | " | 4.0 | " | " | 87 | 12 | 3.4 | 16 |
| 34 | | | | | | | | | |

From the results in Table 1 above, it can be seen that the formation of black pepper formed by the hydrazine compound having adsorptive group shown by formula (II) is remarkably reduced by the use of the compound shown by formula (I) together therewith.

Also, the total evaluations of the performance such as sensitivity, gradation (γ), maximum density (Dmax), and black pepper showed that the use of Compound II-1 or II-22 of formula (II) was superior to the use of Compound II 20, II-21, or II-25. Also, it can be seen that in the compounds of formula (I), the use of Compound I-3,, I-10 or I-15 is better than the use of Compound I-26 in effect.

EXAMPLE 2

In the case of preparing the sample in Example 1-11 described above, 18 mg/m² of the development accelerator having the following formula was further added to the light-sensitive emulsion layer.

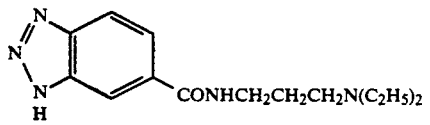

The results obtained showed good photographic performance of 102 in sensitivity, 26 in gradation, 5.5 in Dmax, and 11 in black pepper spots.

EXAMPLE 3

By following the same procedure as Example 2 while further adding 0.2 g/m² (Example 3-1) or 0.4 g/m² (Example 3-2) of a latex of the acid polymer shown below to the light-sensitive emulsion layer, samples of Example 3-1 and Example 3-2 were prepared.

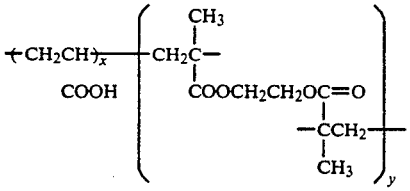

x/y = 50/50 (by mole)

The results obtained are shown in Table 2, which shows the remarkable reduction of black pepper in both the samples.

TABLE 2

| Sample No. | Photograhic Performance Sens. | Gradation (γ) | Dmax | Black Pepper (number) |
|---|---|---|---|---|
| Example 3-1 | 101 | 26 | 5.5 | 5 |
| Example 3-2 | 98 | 24 | 5.3 | 1 |

While the invention has been described in detail and with reference to specific embodiments thereof, it will be apparent to one skilled in the art that various changes and modifications can be made therein without departing from the spirit and scope thereof.

What is claimed is:

1. A negative type silver halide photographic material comprising a support having thereon at least one silver halide emulsion layer containing a spectral sensitizing dye having an absorption maximum in the visible region, wherein the silver halide emulsion layer or another hydrophilic colloid layer provided on the support contains (1) a compound represented by formula (I) having substantially no absorption maximum in the visible region of the spectrum and (2) a hydrazine compound represented by formula (II):

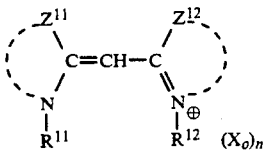

(I)

wherein $Z^{11}$ and $Z^{12}$ each represents a non-metallic atomic group completing a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus, or a quinoline nucleus; $R^{11}$ and $R^{12}$ each represents an unsubstituted or substituted alkyl group, at least one of said $R^{11}$ and $R^{12}$ having an acid group; $X_0$ represents a charge balancing ion; and n represents 0 or 1;

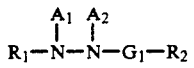

(II)

wherein $A_1$ and $Z_2$ each represents a hydrogen atom, or one of said $A_1$ and $Z_2$ represents a hydrogen atom and the other represents a sulfinic acid group or an acyl group; $R_1$ represents an aliphatic group, an aromatic group, or a heterocyclic group; $R_2$ represents a hydrogen atom, an alkyl group, an aryl group, an alkoxy group, an aryloxy group, or an amino group; at least one of $R_1$ and $R_2$ has an adsorption accelerating group with respect to silver halide; and $G_1$ represents a carbonyl group, a sulfonyl group, a sulfoxy group, a phosphoryl group, or an iminomethylene group.

2. A negative type silver halide photographic material as in claim 1, wherein at least one of $Z^{11}$ and $Z^{12}$ completes a benzoxazole nucleus, a benzothiazole nucleus, or a naphthoxazole nucleus.

3. A negative type silver halide photographic material as in claim 2, wherein $Z^{11}$ and $Z^{12}$ represent a benzoxazole nucleus or a naphthoxazole nucleus.

4. A negative type silver halide photographic material as in claim 1, wherein the hydrazine compound represented by formula (II) is represented by formula (III)

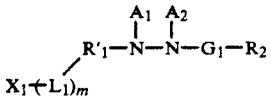

(III)

wherein the groups $A_1$, $A_2$, $R_2$, and $G_1$ are the same as defined for formula (II), $R'_1$ is the same as $R_1$ of formula (II) omitting therefrom one hydrogen atom; $X_1$ represents an adsorption accelerating group; $L_1$ is divalent linking group; and m represents 0 or 1; provided that at least of $R'_1$, $R_2$, and $L_1$ has a group capable of dissociating into an anion having a pKa of at least 6 or an amino group.

5. A negative type silver halide photographic material as in claim 4, wherein the hydrazine compound represented by formula (II) is represented by formula (IV)

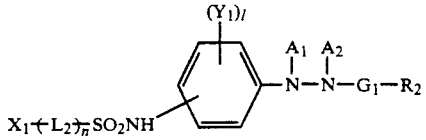

(IV)

wherein the groups $A_1$, $A_2$, $R_2$, $G_1$, and $X_1$ are the same as defined for formula (III); $Y_1$ represents a group selected from an alkyl, aralkyl, alkoxy, aryl, substituted amino, amylamino, sulfonylamino, ureido, urethane, aryloxy, sulfamoyl, carbamoyl, aryl, alkylthio, arylthio, sulfonyl, sulfinyl, hydroxy, halogen, cyano, sulfo and carboxy; $L_2$ represents a divalent linking group; n represents 0 or 1; and l represents 0, 1, or 2; and when l is 2, the two $Y_1$ groups may be the same or different.

6. A negative type silver halide photographic material as in claim 1, wherein the amount of the compound represented by formula (I) is in the range of from $10^{-6}$ to $10^{-2}$ mole per mole of silver halide, and the amount of the hydrazine compound represented by formula (II) is from $10^{-6}$ to $10^{-1}$ mole per mole of silver halide.

7. A negative type silver halide photographic material as in claim 6, wherein the amount of the compound represented by formula (I) is in the range of from $10^{-5}$ to $5\times10^{-3}$ mole per mole of silver halide, and the amount of the hydrazine compound represented by formula (II) is from $10^{5}$ to $4\times10^{-3}$ mole per mole of silver halide.

8. A negative type silver halide photographic material as in claim 1, wherein said spectral sensitizing dye having an absorption maximum in the visible region is

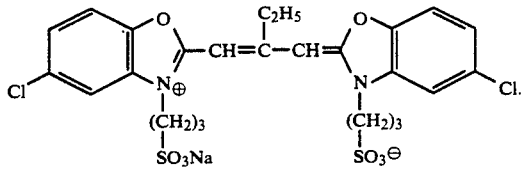

9. A method for forming a superhigh contrast negative image, comprising the steps of image-wise exposing a negative type silver halide photographic material comprising a support having thereon at least one silver halide emulsion layer containing a spectral sensitizing dye having an absorption maximum in the visible region, wherein the silver halide emulsion layer or another hydrophilic colloid layer provided on the support contains (1) a compound represented by formula (I) having substantially no absorption maximum in the visible region of the spectrum and (2) a hydrazine compound represented by formula (II):

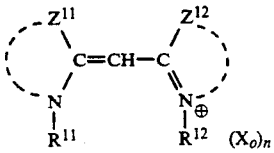

(I)

wherein $Z^{11}$ and $Z^{12}$ each represents a non-metallic atomic group completing a benzoxazole nucleus, a benzothiazole nucleus, a benzoselenazole nucleus, a naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus, a benzimidazole nucleus, or a quinoline nucleus; $R^{11}$ and $R^{12}$ each represents an unsubstituted or substituted alkyl group, at least one of said $R^{11}$ and $R^{12}$ having an acid group; $X_0$ represents a charge balancing ion; and n represents 0 or 1;

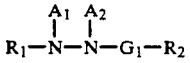

(II)

wherein $A_1$ and $A_2$ each represents a hydrogen atom, or one of said $A_1$ and $Z_2$ represents a hydrogen atom and the other represents a sulfinic acid group or an acyl group; $R_1$ represents an aliphatic group, an aromatic group, or a heterocyclic group; $R_2$ represents a hydrogen atom, an alkyl group, an aryl group, an alkoxy group, an aryloxy group, or an amino group; at least one of $R_1$ and $R_2$ has an adsorption accelerating group with respect to silver halide; and $G_1$ represents a carbonyl group, a sulfonyl group, a sulfoxy group, a phosphoryl group, or an iminomethylene group, and developing the image-wise exposed photographic material to provide a processed photographic material having a reduced occurrence of black pepper spots while leaving no residual color.

10. A method for forming a high contrast negative image as in claim 9, wherein said spectral sensitizing dye having an absorption maximum in the visible region is

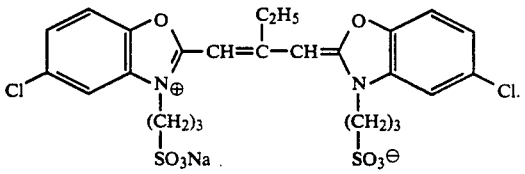

* * * * *